US006039095A

United States Patent [19]

Newman

[11] Patent Number: 6,039,095

[45] Date of Patent: Mar. 21, 2000

[54] ADJUSTABLE ROUTER GUIDE PLATFORM WITH INTEGRATED CLAMP

[76] Inventor: Roger R. Newman, 20 Lytton Boulevard, Toronto, Canada, M4R 1L1

[21] Appl. No.: 09/207,515

[22] Filed: Dec. 9, 1998

[51] Int. Cl.[7] ..... B27M 3/00

[52] U.S. Cl. ..... 144/144.52; 409/125; 409/130

[58] Field of Search ..... 144/135.2, 135.3, 144/137, 144.52, 253.5, 139; 269/208, 209

[56] References Cited

U.S. PATENT DOCUMENTS

| | | | |
|---|---|---|---|
| 3,734,151 | 5/1973 | Skripsky | 144/1 R |
| 4,215,731 | 8/1980 | Maynard | 144/136 C |
| 4,434,824 | 3/1984 | Bussey | 144/134 |
| 4,735,531 | 4/1988 | Boerckel | 409/182 |
| 4,911,419 | 3/1990 | Deakin et al. | 269/208 |
| 5,016,358 | 5/1991 | Rice et al. | 33/569 |
| 5,052,454 | 10/1991 | Meinhardt | 144/144.5 R |
| 5,345,986 | 9/1994 | Kieffer | 144/372 |
| 5,458,171 | 10/1995 | Ward | 144/84 |
| 5,494,089 | 2/1996 | Lubbe | 144/144 R |
| 5,533,556 | 7/1996 | Whitney | 144/144.52 |

OTHER PUBLICATIONS

De Cristoforo, R.J., *The Portable Router Book, 2nd Edition* (Blue Ridge Summit, PA: Tab Books, 1994) pp. 131–134.

*Primary Examiner*—Joseph J. Hail, III
*Assistant Examiner*—Dermott J. Cooke
*Attorney, Agent, or Firm*—Bereskin & Parr

[57] ABSTRACT

The present invention provides an apparatus for securely clamping and routing straight or rectangular grooves, slots, and recesses into the sides or edges of a workpiece. The apparatus comprises opposed front and rear jaw-pieces located on opposite sides of a gap for receiving a workpiece; clamping means connected to the jaw-pieces for clamping the front and rear jaw-pieces to the workpiece located in the gap; a platform area means for supporting the router over the workpiece, the platform area being provided on at least one of the front and rear jaw-pieces; and a laterally adjustable guiding means, for guiding the router, and provided on the platform area, the laterally adjustable guiding means comprising at least one guide fence positioned parallel to the gap.

17 Claims, 13 Drawing Sheets

ADJUSTABLE ROUTER GUIDE PLATFORM WITH INTEGRATED CLAMP

FIELD OF THE INVENTION

This invention relates to an apparatus which securely clamps a workpiece and provides a stable supporting platform for a router, enabling the routing of straight or rectangular grooves, slots, and recesses of a continuous range of widths into the sides or edges of the workpiece.

BACKGROUND OF THE INVENTION

In order to rout a groove, slot, or recess into the side or edge of a workpiece, it is generally necessary to secure the workpiece by means of a clamp or the like, and to provide a stable supporting platform and a guiding fence for the router baseplate.

Some prior art clamps provide a support area on the top surface of the clamp jaws for supporting a router base or sub-base. One example of such a prior art clamp is found in De Cristoforo, R. J., *The Portable Router Book, 2nd Edition* (Blue Ridge Summit, Pa.: Tab Books, 1994) at pp. 131–134. FIG. 9–21 on p. 133 shows workpieces gripped between the jaws of a vise clamp. The workpieces are held lower than the top surfaces of the jaws which provide a support area for a router base or sub-base. The vise clamp, in turn, is secured to a bench vise. FIG. 9–22 on p. 133 shows the bottom-side of a router sub-base having two parallel adjustable guides attached to either side of an access hole for a router bit. The router sub-base is used in conjunction with the clamping arrangement shown in FIG. 9–21, as illustrated in FIG. 9–23 on p. 134.

While this prior art clamping and router sub-base apparatus is useful for making certain controlled router cuts into a workpiece, it suffers from a number of drawbacks. One drawback is that a router sub-base must be attached to the router for operation. While using a sub-base is desirable in certain situations (as demonstrated in some of the present inventor's co-pending applications), in the present application, making a precise router cut into a small, clamped workpiece can be made more difficult by the additional bulk of the sub-base and the friction of the parallel adjustable guides sliding along the outside of the clamps. In addition, it is assumed that the outer sides of the vise clamp are true and parallel to each other, which may not be the case.

Another drawback is that the device shown in the De Cristoforo reference is not designed to rout grooves that are wider than the router bit cutting diameter, although this could potentially be done if the guides are set wider than the width of the jaw clamps. However, since lateral or side-to-side movement is necessary in order to cut a groove or slot in the workpiece that is wider than the cutting diameter of the router bit (i.e. a rectangular groove or slot), the narrow support area formed by the top surface of the jaws of the vise clamp may cause the sub-base to become unstable if moved too far to the front or to the back. This is particularly a serious problem where the clamped workpiece is narrow and the jaws of the vise clamp are also narrow in comparison to the diameter of the router base.

Also, the construction details for the vise clamp, shown in FIG. 9–19, on page 132 of De Cristoforo, makes clear that the length of the workpiece is limited to what would fit between the two carriage bolts.

Finally, in the prior art apparatus, there is no apparent way to control the length of the router cut, nor is there a way to form a side-to-side straight edge at either end of a router cut. This precludes cutting a true rectangular groove or slot.

SUMMARY OF THE INVENTION

The present invention provides an apparatus for securely clamping a workpiece and supporting a router above the workpiece to enable the routing of straight or rectangular grooves, slots, and recesses into the sides or edges of the workpiece and which overcomes the drawbacks inherent in prior art devices, as discussed above. For the purpose of discussion in this specification, the apparatus which is the subject matter of the present invention will often be referred to as a "sideguide", as it provides guides or fences along sides of a workpiece.

In a first aspect, the present invention provides an apparatus for use with a router and a workpiece, the router having a baseplate, an edge on the baseplate for guiding the router, and a router bit extending down below the baseplate for rotation about a router axis, the apparatus comprising: opposed front and rear jaw-pieces located on opposite sides of a gap for receiving the workpiece and being movable towards and away from one another; clamping means connected to the jaw-pieces, said clamping means being actuatable, in use, to draw the front and rear jaw-pieces together, thereby to clamp said workpiece in the gap between the front and rear jaw-pieces, said clamping means being located above the front and rear jaw-pieces, so as not to obstruct the jaw-pieces and to permit a workpiece of indefinite length to be clamped between the front and rear jaw-pieces; a platform area means for supporting said router over the workpiece, a platform area being provided on each of the front and rear jaw-pieces; and platform area holding means for maintaining said platform areas on said front and rear jaw-pieces coplanar.

Preferably, the present invention provides an apparatus as described above wherein the platform area means comprises a front platform area mounted on the front jaw-piece and a rear platform area mounted on the rear jaw-piece.

Advantageously, the laterally adjustable guide means comprises a front guide fence adjustably mounted on the front platform area and a rear guide fence adjustably mounted on the rear platform area, the front and rear guide fences being adjustable towards and away from the gap.

More preferably, the present invention provides jaw-pieces which include substantially planar clamping surfaces which are parallel to one another, and which face one another and wherein the front and rear platform areas are substantially perpendicular to the clamping surfaces and flush therewith.

The clamping means can comprise first and second clamps provided at either end of the gap, wherein each clamp comprises an elongate screw member rotatably mounted to one of the front and rear jaw-pieces, and an engagement member including a threaded bore, which the elongate screw member engages, the engagement member being mounted to the other of the front and rear jaw-pieces.

To compensate or allow for screw clamps having a limited range of motion, the screw clamps are preferably adjustably mounted to at least one of the front and rear jaw-pieces, to increase the respective range of motion thereof.

The apparatus can include end stops at either end of the gap, for limiting movement of the router along the gap.

BRIEF DESCRIPTION OF THE DRAWINGS

For a better understanding of the present invention, and to show more clearly how it may be carried into effect, reference will be made by way of example to the accompanying drawings which show a preferred embodiment of the present invention, and in which.

DETAILED DESCRIPTION OF THE INVENTION

Figure 1:
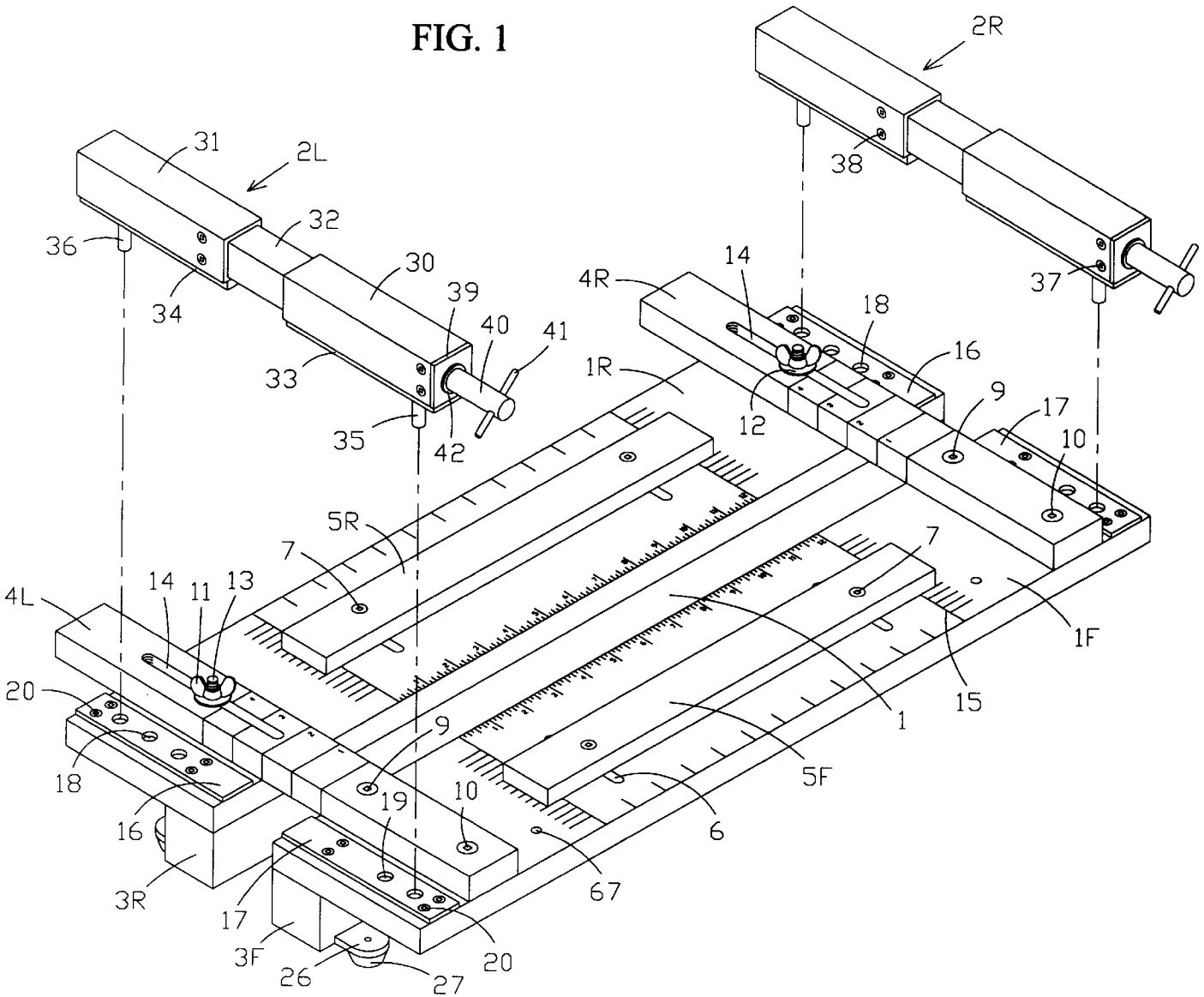
FIG. 1 shows an isometric view of the sideguide, with left and right pin-clamps shown removed.
Figure 2:
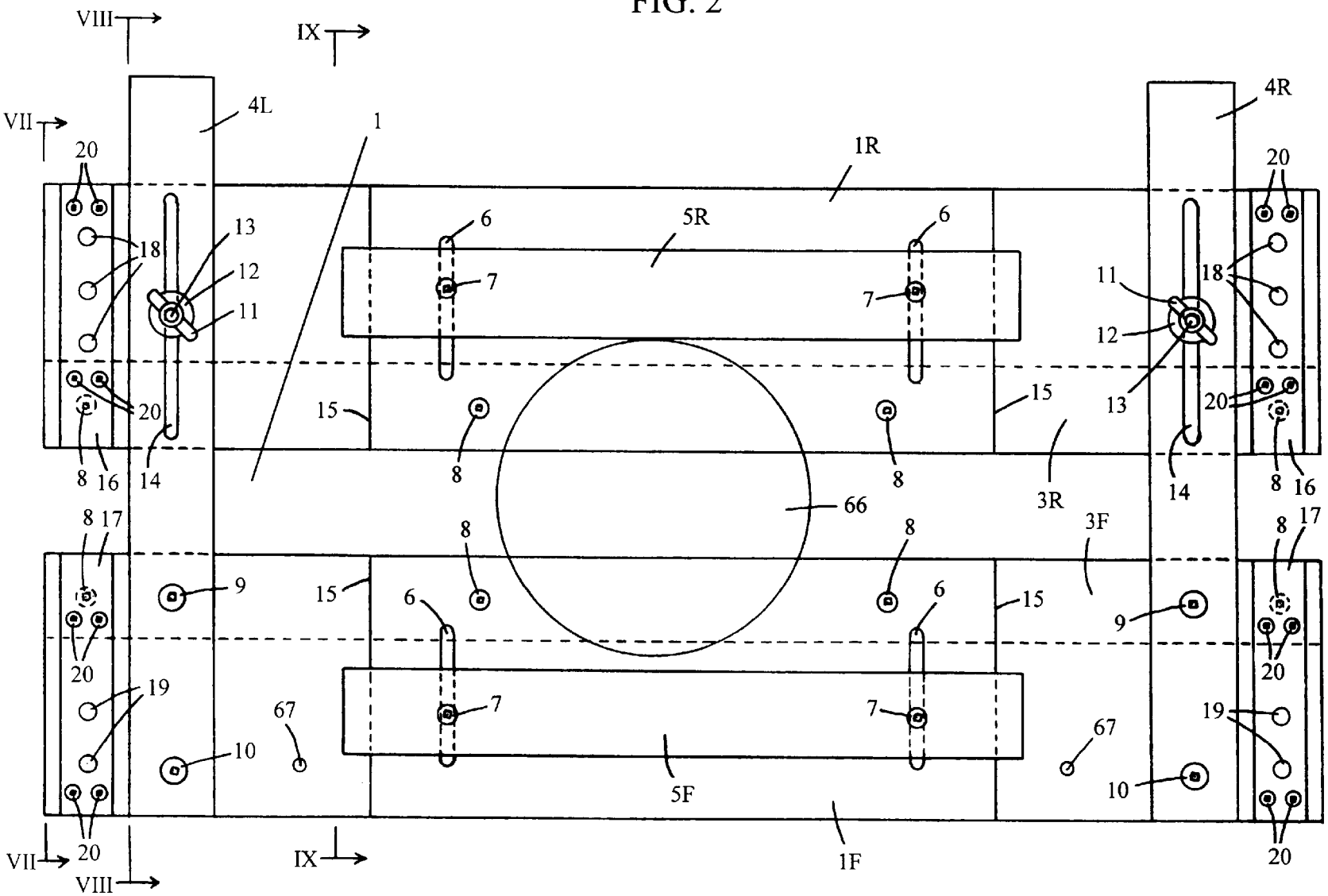
FIG. 2 shows a top view of the sideguide with left and right pin-clamps removed.

FIG. 1 shows a perspective view of a sideguide or apparatus for guiding a router, with left and right pin-clamps 2L, 2R shown in lifted position. Normally, the pin-clamps 2L, 2R would be seated on rear and front metal plates 16, 17, as detailed below. FIG. 2 shows a top view of the sideguide with pin-clamps removed. Referring to FIG. 1, the apparatus has front and rear platform areas 1F, 1R, which are fastened to front and rear jaw-pieces, 3F, 3R, by flat-headed wood screws 8 shown in FIG. 2. Mounted near the ends of the top of platform areas 1F, 1R are left and right fixed end stops 4L, 4R which are attached directly onto the front platform area 1F by means of long flat-headed stove bolts 9. These stove bolts pass right through the front platform area 1F and then screw into the inside of the front jaw-piece 3F. The fixed end stops 4L, 4R are also attached to the front platform area 1F by means of short flat-headed stove bolts 10. The fixed end stops 4L, 4R have long slots 14 cut into them, so that the rear platform area 1R can be adjusted relative to the front platform area 1F. The fixed end stops 4L, 4R also function to ensure that the front and rear platform areas 1F, 1R are held square, and in the same horizontal plane as each other, when they straddle the work-piece which will be clamped between them.

At each extreme end of the front platform area 1F are metal plates 17, which are fastened onto the platform area 1F by means of flat-headed wood screws 20. Similarly, at each extreme end of the rear platform area 1R, are metal plates 16 which are fastened onto the platform area 1R by means of flat-headed wood screws 20. Slots 6 have been cut into the front and rear platform areas 1F, 1R so that rear and front guide fences 5R, 5F can be laterally adjusted to set the front and rear limits of any groove, slot, or recess in the workpiece by controlling the baseplate of any standard hand-held router, which slides on the top surfaces of the front and rear platform areas 1F, 1R. Lines 15 are marked on the top surfaces of the front and rear platform areas to indicate where the end limits of the centre of the router-blade would be, when the base plate of the hand-held router reaches either of the fixed end-stops 4L, 4R. The front and rear guide fences 5F, 5R are locked in position by means of flat-headed machine screws 7.

The front and rear platform areas 1F, 1R and jaw-pieces 3F, 3R define a gap 1 for a workpiece. This gap 1 will usually be parallel sided, and afterwards the guide fences 5F, 5R will usually be secured parallel to the parallel sided gap 1. However, the gap 1 could be tapered to a limited extent for certain applications. This movement away from parallel will be limited by the tolerances in the various joints.

When a workpiece is clamped between the jaws of the sideguide, and the top surface of the workpiece is made the same height as or lower than the platform areas of the sideguide, the base of the router will be sliding directly on the platform areas. The platform areas will provide a smooth, flat and true reference surface for the router base no matter how rough, uneven or narrow the top surface of the workpiece might be. In addition, while it is generally expected that both the front and rear platform areas 1F, 1R will provide support, it is possible to have only one of the platform areas supporting the router baseplate. In this situation, the workpiece itself may provide a suitable support surface if the workpiece is flush with the top of the platform areas 1F, 1R and the top surface of the workpiece is smooth, flat and true. If the workpiece is long enough, the fixed end-stops 4L, 4R at each end of the sideguide can aid in positioning the workpiece flush with the top surface of the platform areas. Note that, if the required groove, slot or recess in the workpiece is to have exactly the same width as the diameter of a router bit, then only one guide fence needs to be adjusted and used. In this case, the router should be slid from left to right if the rear fence is used, or from right to left if the front fence is used. The significance of the direction of the cut is explained further below.

Figure 3:
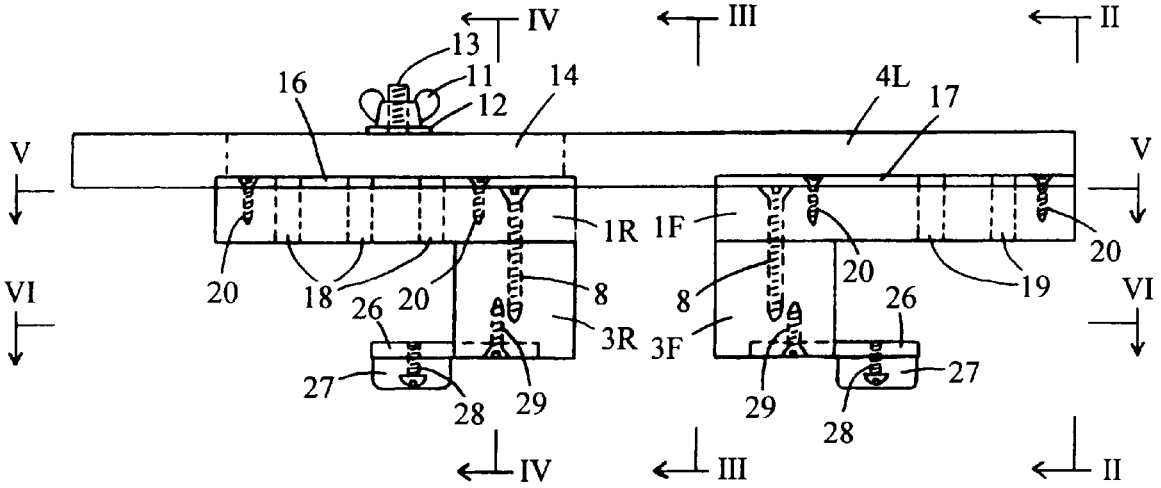
FIG. 3 shows a left end view of the sideguide, with left and right pin-clamps removed, along line VII—VII in FIG. 2.

FIG. 3 shows a left end view of the sideguide. In this view, the flat-headed wood screws 8 are shown clearly embedded into the front and rear jaw-pieces 3F, 3R. Metal plates 16, 17 are shown fastened onto the front and rear platform areas by flat-headed wood screws 20. FIG. 3 also shows rubber feet 27 attached to the bottom of front and rear jaw-piece 3F, 3R by means of brackets 26 and fasteners 28, 29. These rubber feet are used when the workpiece is small enough to be held between the jaws while the sideguide is resting on a flat workbench surface. Alternatively, if the workpiece is large or long, the sideguide can be clamped onto the workpiece and be supported by the fixed end-stops 4L, 4R resting on the workpiece. For example, such workpieces could include the edges of doors or windows which would be independently supported. To accommodate longer lengths of grooves or slots, it is possible to build the sideguide in various lengths with only the central platform areas and fences being lengthened. However, it is cautioned that the workpiece being clamped should not be less than about one-half the length of the sideguide itself, because this may place too much strain on the jaws of the sideguide when the pin-clamps are tightened. A thicker design for the jaws may alleviate this problem somewhat. Additional clamping can be provided when mounting short workpieces by applying a C clamp underneath the sideguide and clamping the outside of the jaws directly. Also, if the workpiece is warped or uneven, then it may be necessary to add small wedges to ensure adequate and even clamping of the workpiece.

Figure 4:
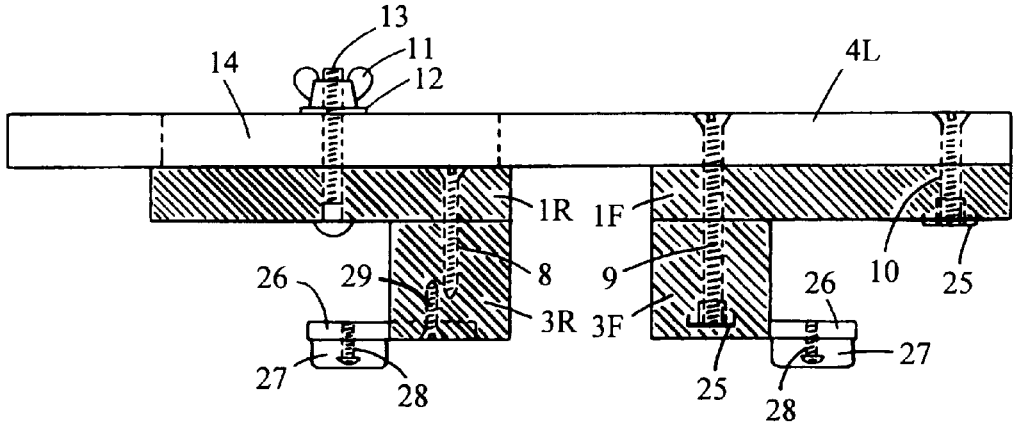
FIG. 4 shows an end cross-sectional view along line VIII—VIII in FIG. 2.

FIG. 4 shows the long flat-headed stove bolts 9 fastening down fixed end stop 4L to the front platform area 1F and front jaw-piece 3F. Each stove bolt 9 screws into one embedded spiked T-nut 25 inside of the front jaw-piece 3F. FIG. 4 also shows fixed end stop 4L attached to the rear platform area 1R by means of a captive (press-fit) carriage bolt 13 which passes through slot 14 and washer 12 before being fastened to wingnut 11.

Figure 5:
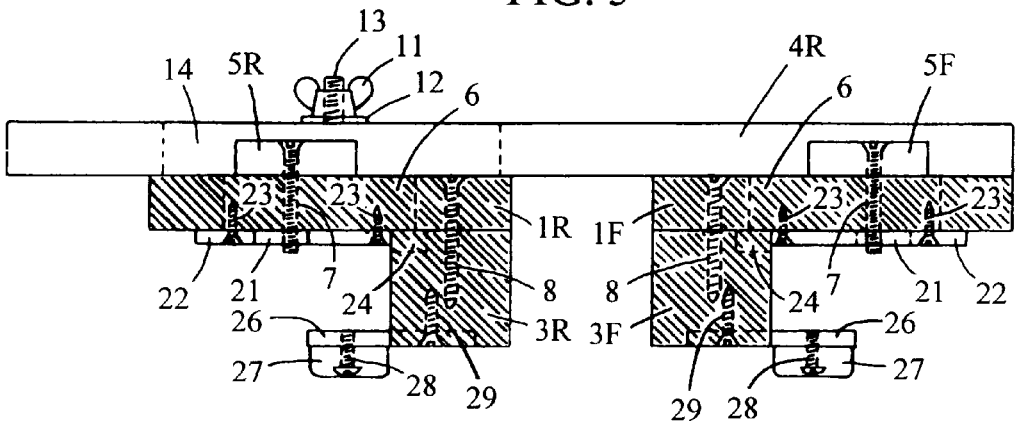
FIG. 5 shows an end cross-sectional view along line IX—IX of FIG. 2.

Now referring to FIG. 5, machine screws 7 are shown passing through holes in the front and rear guide fences 5F, 5R then through the slots 6 in the front and rear platform areas 1F, 1R before being screwed into rectangular shaped restricted nuts 21. These restricted nuts 21 are free to slide underneath the front and rear platform areas of the sideguide.

Figure 6:
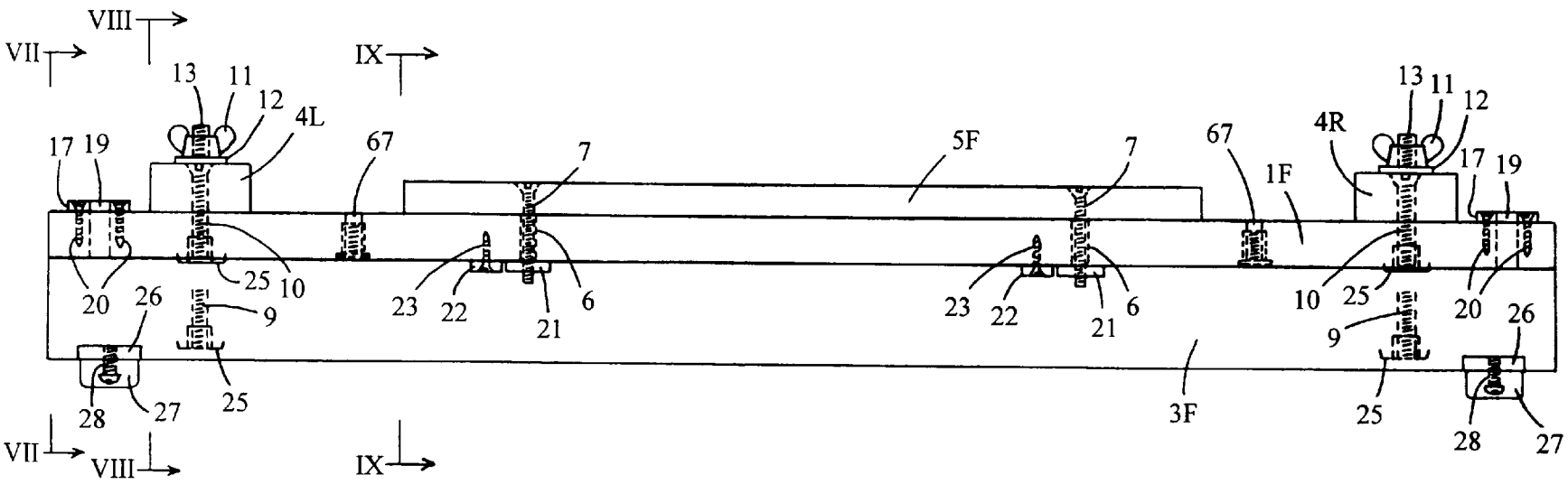
FIG. 6 shows a front view of the sideguide with left and right pin-clamps removed along line II—II of FIG. 3.
Figure 7:
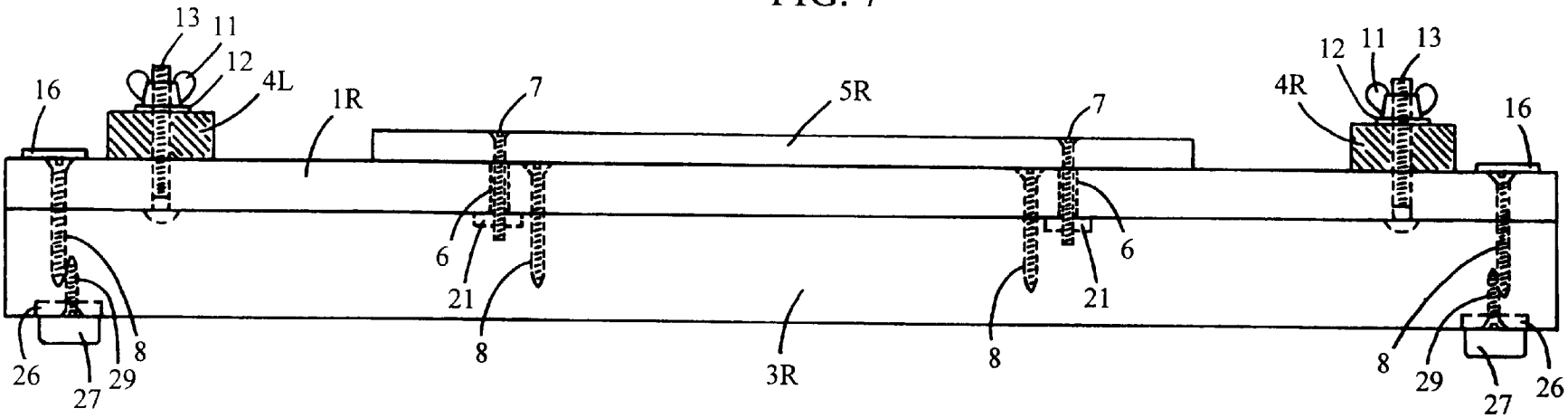
FIG. 7 shows a front cross-sectional view along line III—III of FIG. 3.

FIG. 6 shows a front view of the sideguide. As shown, the restricted nuts 21 are prevented from rotating by means of metal bars 22 which are placed parallel to the slots 6 and are fastened onto the underside of the front and rear platform areas by means of flat-headed wood screws 23. Also shown in FIG. 6 are metal plates 17 attached to the front platform area 1F by means of flat-headed wood screws 20. Holes 19 pass through metal plates 17 and the front platform area 1F and receive solid pins 35 (shown in FIG. 1) of pin-clamps as detailed below. FIG. 7 shows a front cross-sectional view of the sideguide as viewed from line III—III indicated in FIG. 3. FIG. 7 shows left and right fixed end stops 4L, 4R secured to rear platform area 1R by means of captive carriage bolts 13, washers 12, and wingnuts 11.

Figure 8:
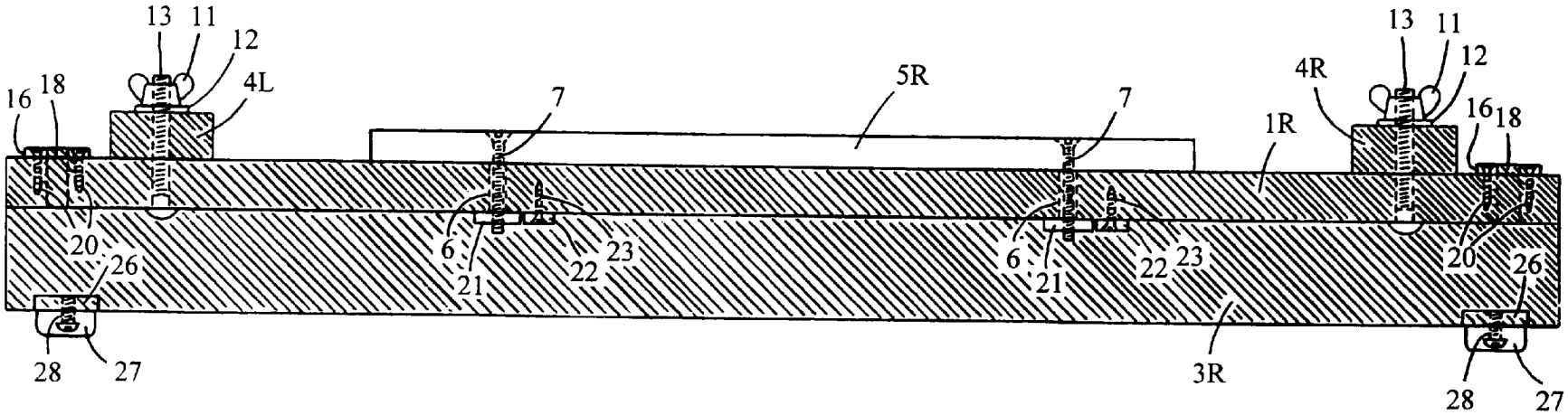
FIG. 8 shows a front cross-sectional view along line IV—IV of FIG. 3.

FIG. 8 shows a front cross-sectional view of the sideguide taken at line IV—IV of FIG. 3. Similar to FIG. 6, FIG. 8 shows restricted nuts 21 being prevented from rotating by metal bars 22 which are placed parallel to the slots 6 and are fastened onto the underside of the rear platform area 1R by means of flat-headed wood screws 23. Alternatively, T-nuts could be used to fasten down the front and rear guide fences instead of the restricted rectangular nuts 21 and the metal bars 22.

Figure 9:
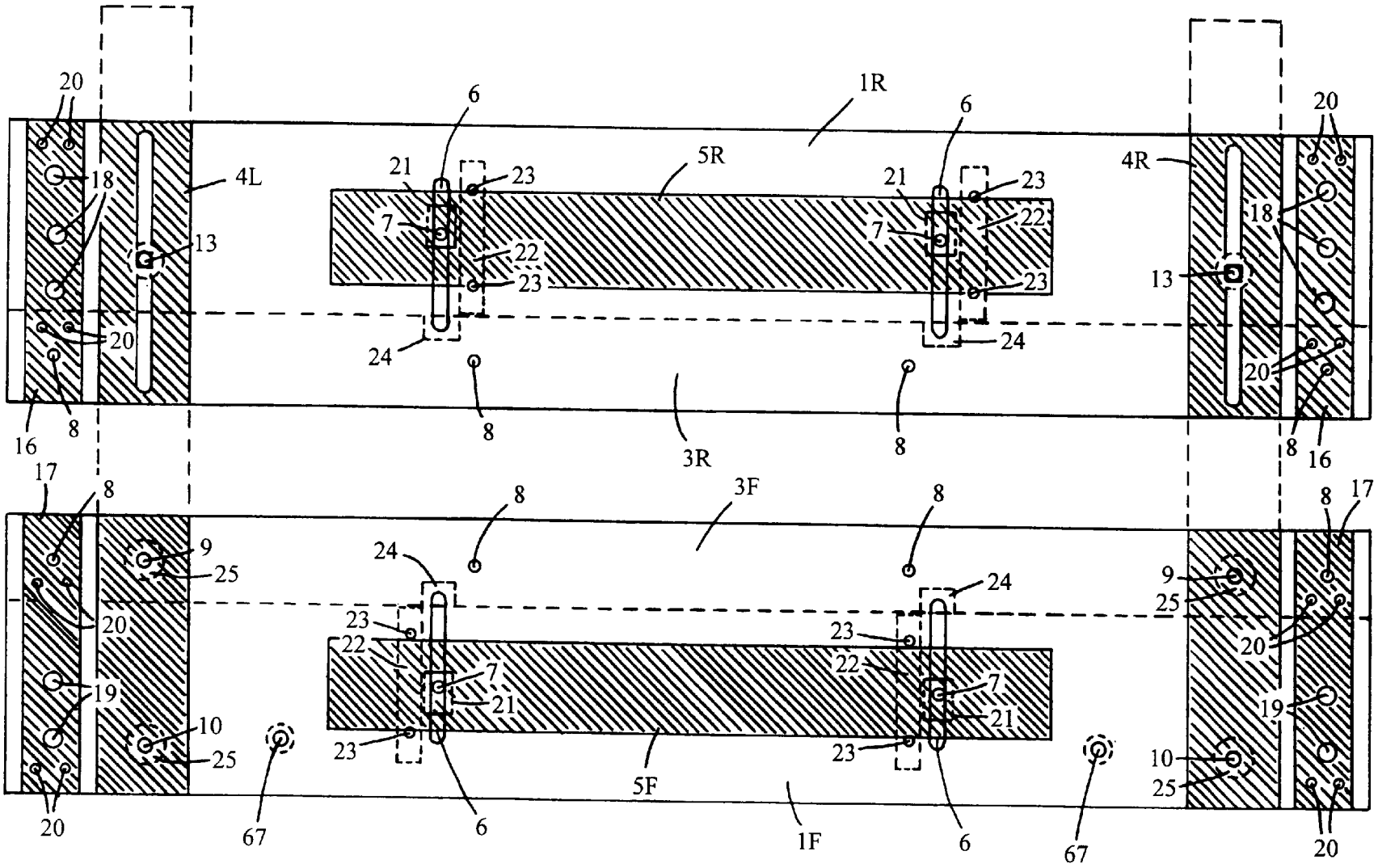
FIG. 9 shows a top cross-sectional view of the sideguide taken from line V—V in FIG. 3.
Figure 10:
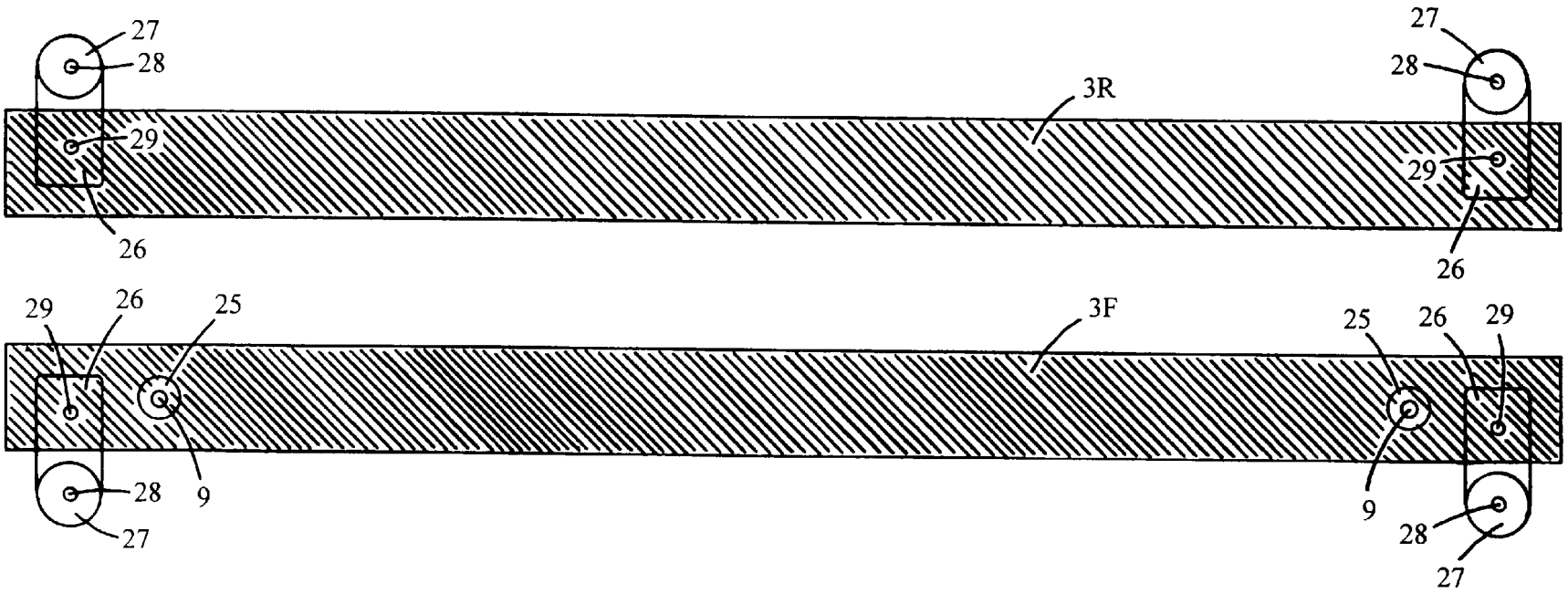
FIG. 10 shows a top cross-sectional view of the sideguide along line VI—VI of FIG. 3.

Now referring to FIG. 9, a top cross-sectional view along line V—V of FIG. 3, shows that the front and rear jaw-pieces 3F, 3R have notches 24. These notches allow the restricted nuts 21 to slide into the jaw-pieces 3F, 3R, when the front and rear guide fences 5F, 5R are in their fully forward positions. FIG. 9. also shows another view of metal bars 22 which are placed parallel to the slots 6 and are fastened onto the underside of the front and rear platform areas 1F, 1R.

Figure 11:
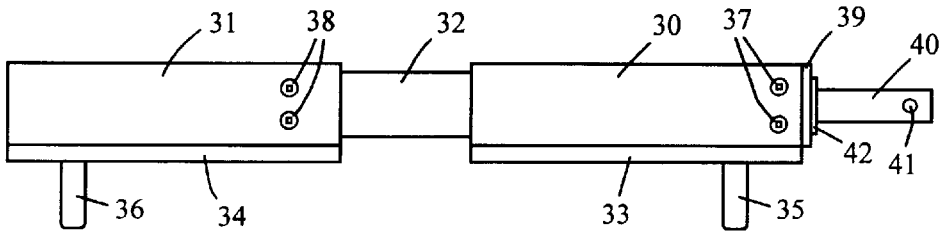
FIG. 11 shows a side view of a pin-clamp.

Now referring to FIG. 11, one of the pin-clamps 2L, 2R is shown in a side view, the two pin-clamps 2L, 2R being identical. The pin-clamp shown in FIG. 11, comprises a rear section 31, a mid-section 32, and a front section 30. The rear section 31 is a box-shaped tube which is fastened onto the mid-section 32 (mid-section 32 being a smaller box-shaped tube) by means of flat-headed machine screws 38. The mid-section 32 slides freely inside the front section 30 which is also a box-shaped tube. As a result, the distance between front and rear pins 35, 36 is freely adjustable, within the limits set by the handle assembly, so that the pins can be fitted easily into the pin holes 18, 19 (as shown in FIG. 1) at each end of each of the sideguide platform areas. Note that the plurality of pin holes at each end of the sideguide platform areas, as shown in FIG. 1, allows the pin clamps to be installed in the most appropriate pin holes so that only minimal adjustment of the pin-clamp handles is necessary.

Figure 12:
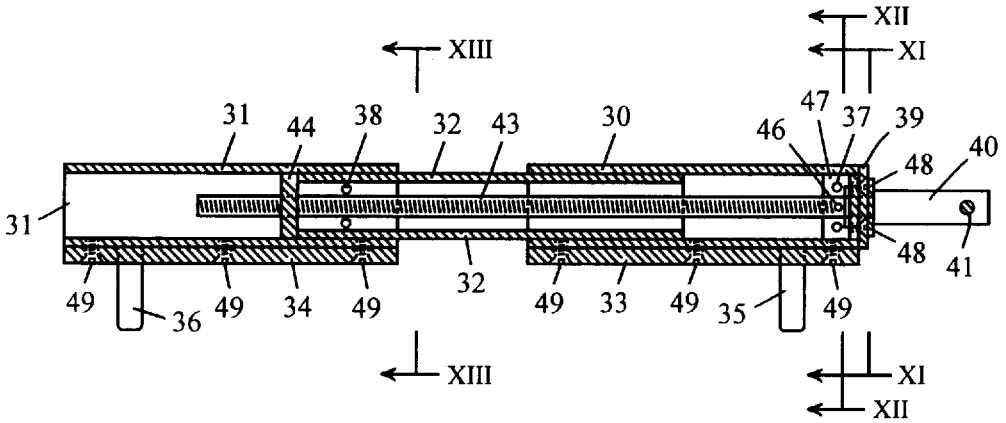
FIG. 12 shows a side cross-sectional view along line X—X of FIG. 13.

FIG. 12 shows a side cross-section view of one pin-clamp. A cover-plate 39 is held in place by flat-headed machine screws 48 which screw into a bracket 47. The bracket 47 is fitted inside the front end of the front section 30 and is held in place by flat-headed machine screws 37. As shown in FIG. 12, the pin-clamp handle assembly, which consists of a body 40 with a press-fit rod 41 through it, is attached to a long threaded rod 43. This threaded rod 43 passes through clearance holes in both the cover-plate 39 and the bracket 47, to occupy the central area through the front section 30 and the smaller box-shaped tube 32 and then partly into the rear section 31. A washer 42 is inserted between the handle assembly body 40 and the front cover-plate 39.

Figure 13:
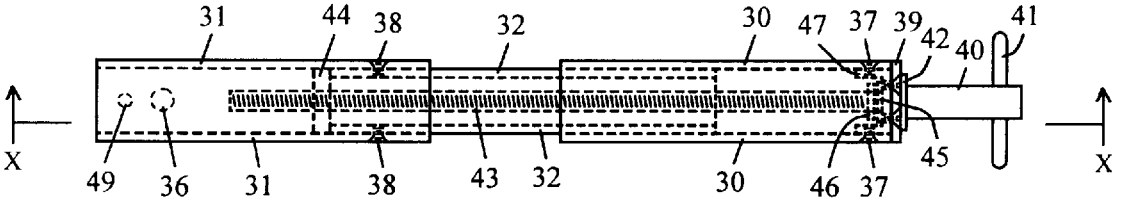
FIG. 13 shows a top view of the pin-clamp.
Figure 14:
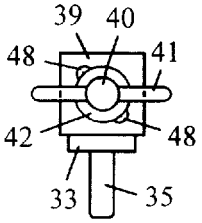
FIG. 14 shows a front view of the pin-clamp.
Figure 15:
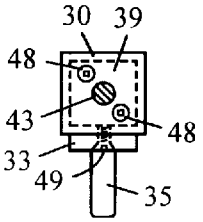
FIG. 15 shows a front cross-sectional view of the pin-clamp along line XI—XI of FIG. 12.
Figure 16:
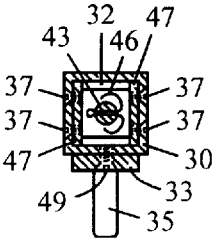
FIG. 16 shows a front cross-sectional view of the pin-clamp along line XII—XII of FIG. 12.
Figure 17:
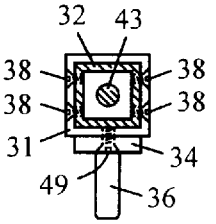
FIG. 17 shows a front cross-sectional view of the pin-clamp along line XIII—XIII of FIG. 12.

Now referring to FIG. 13, a smaller diameter washer 45 is located behind the bracket 47 and a cotter pin 46 is inserted through a hole in the threaded rod 43. This arrangement holds the threaded rod 43 and the handle assembly 40, 41 captive to the front cover plate 39, while at the same time allowing the threaded rod 43 and the handle assembly 40, 41 to rotate freely. The long threaded rod 43 is screwed into the large square nut 44 which, when it is butting up against the rear end of the smaller box-shaped tube 32, will draw the rear section 31 and the smaller box-shaped tube closer towards the front section 30, when the handle assembly 40, 41 is turned clock-wise. Because the large square nut 44 can slide freely inside the rear section 31 (whenever it is not butting against the rear end of the smaller box-shaped tube 32) it allows the rear section 31 to move freely toward the front section 30. However, the rear section 31 cannot be displaced farther away from the front section 30 than the limit set by the position of the large square nut 44 on the threaded rod 43.

Referring back to FIG. 12, underneath the rear section 31, is a solid base plate 34, which is fastened onto the underside of the rear section 31, by means of flat-headed machine screws 49. Riveted into the solid base plate 34 is a solid pin 36 which projects downwards underneath the rear section 31. Again referring to FIG. 12, underneath the front section 30 is another solid base plate 33, which is fastened onto the underside of the front section 30 by means of flat-headed machine screws 49. Riveted into the solid base plate 33 is a similar solid pin 35, which projects downwards underneath the front section 30.

Reference will now be made to FIGS. 18–25 which show details of adjustable end stops. The adjustable end stops are used whenever a definite limit is required for any groove or recess, and the limit needs to be set by other than one or both of the fixed end stops 4L, 4R.

Figure 18:
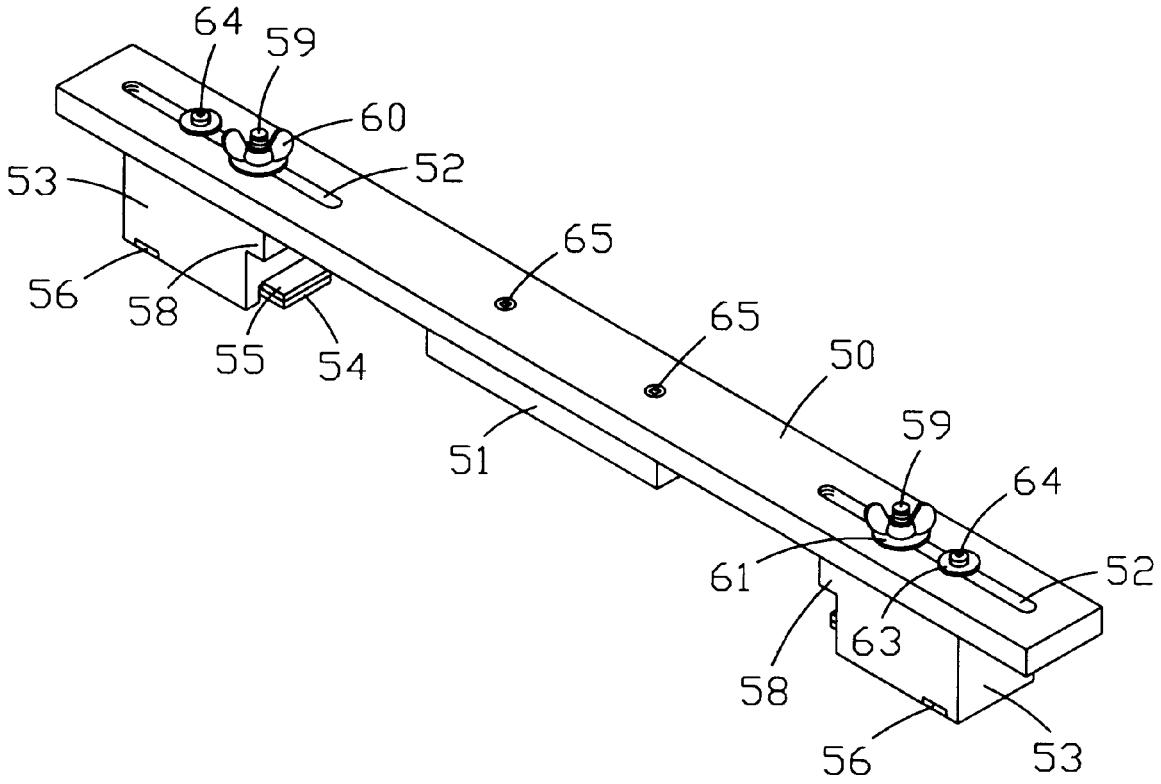
FIG. 18 shows an isometric view of an adjustable end stop.
Figure 19:
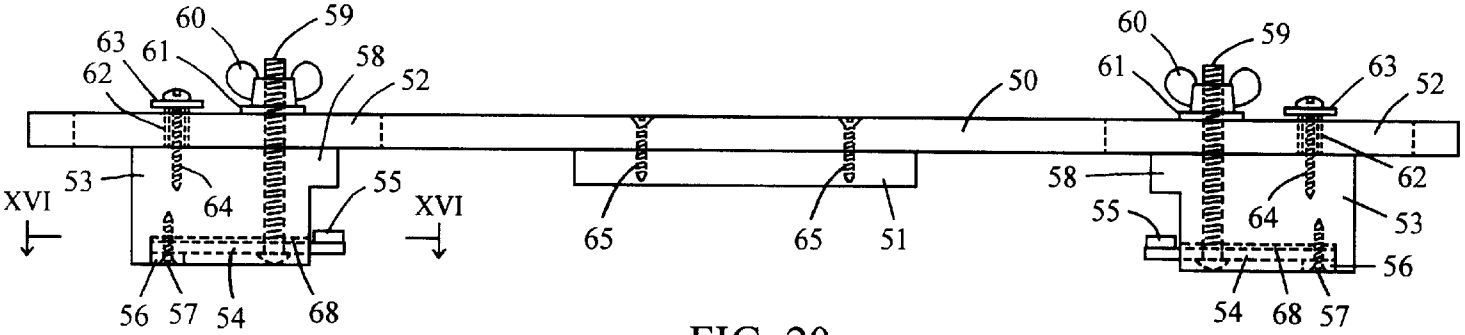
FIG. 19 shows a side view of the adjustable end stop shown in FIG. 18.
Figure 20:
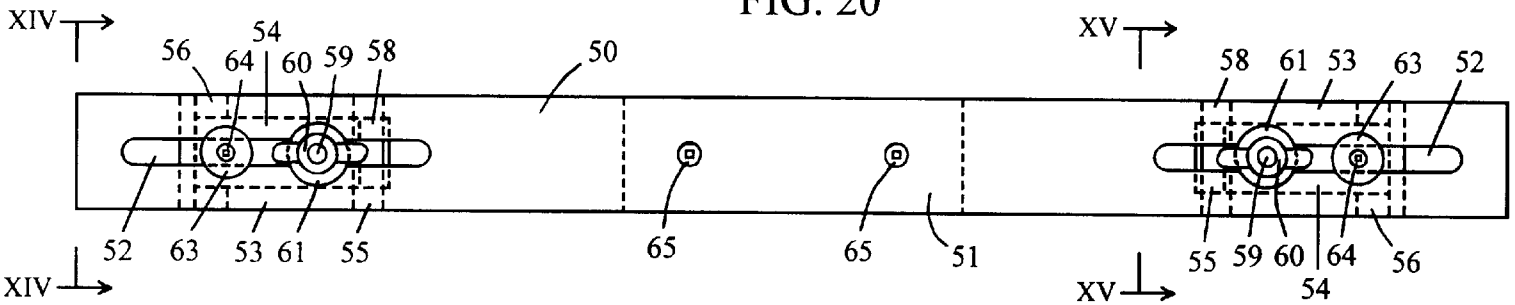
FIG. 20 shows a top view of the adjustable end stop.
Figure 23:
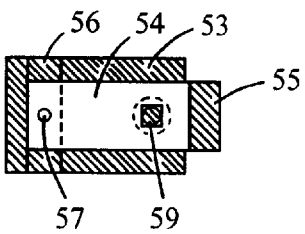
FIG. 23 shows a top cross-sectional view of the securing assembly along line XVI—XVI of FIG. 19.
Figure 22:
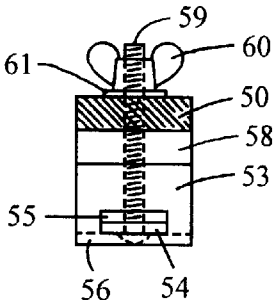
FIG. 22 shows an end cross-sectional view along line XV—XV of FIG. 20.
Figure 21:
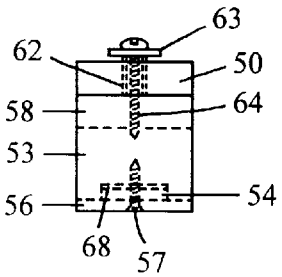
FIG. 21 shows an end view of an adjustable end stop taken from line XIV—XIV in FIG. 20.
Figure 24:
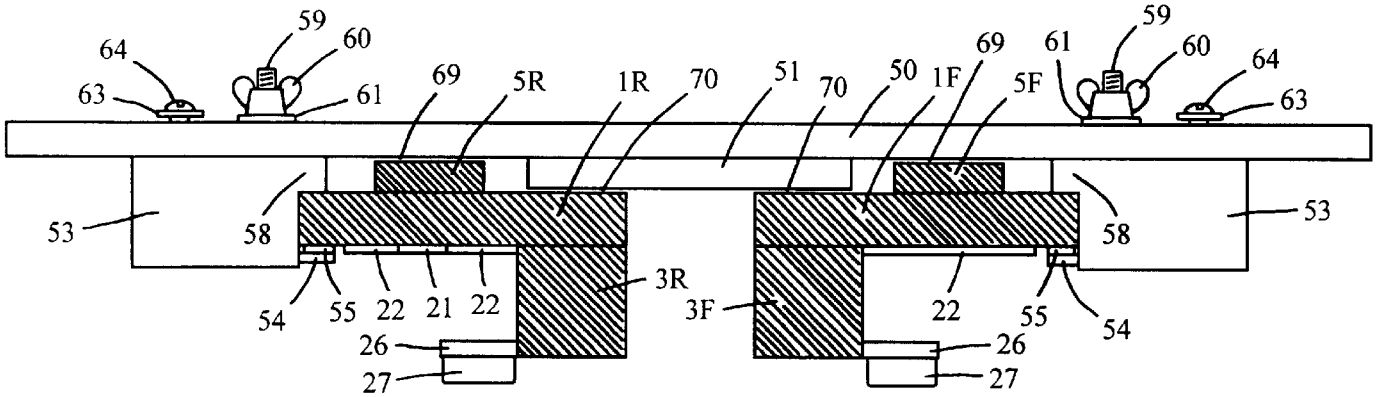
FIG. 24 shows a cross-sectional end view of the sideguide, showing how the adjustable end-stop is attached.

Referring to FIG. 18, the main body 50 of an adjustable end stop is of sufficient length so that it will span across the overall width of the sideguide front and rear platform areas 1F, 1R, when the maximum width of the workpiece is clamped between them. Near the end of the main body 50 are slots 52 which allow two clamping block assemblies 53 to be adjusted inwards or outwards, so that the adjustable end stop can be installed or removed, for various widths of work pieces. Located in the middle of the main body 50 is the adjustable end stop fence 51, which is fastened to the main body 50 by means of flat headed wood screws 65. Referring to FIG. 19, each clamping block assembly 53 has a projecting shelf region 58, which is slightly thicker than the thickness of the end stop fence 51 and slightly thicker also than the thickness of the front and rear guide fences 5F, 5R. This is so that, when the projecting shelf region 58 of each clamping block assembly 53 is resting on the top surfaces of the front and rear platform areas 1F, 1R of the sideguide, there will be clearance 69 (as shown in FIG. 24) between the front and rear guide fences 5F, 5R and the main body 50 of the adjustable end stop. It will also provide clearance 70 between the adjustable end stop fence 51 and the front and rear platform areas 1F, 1R. The underside of each clamping block assembly 53 has been recessed a sufficient amount 68 (as shown in FIG. 21) to allow a clamping bar 54 to tilt up and down slightly about its end which is secured by a cross-bar 56. The cross bar 56 is also recessed into the underside of each clamping block assembly 53, and is held in place by a flat headed wood screw 57 that also passes through a loose clearance hole in the clamping bar 54. The top end of a carriage bolt 59 passes through the respective slot 52 at one end of the main body 50, and then it is secured by a large washer 61 and a wingnut 60. The upper surface of each clamping bar 54, on the tilting end (opposite the secured end) has a rubber clamping pad 55 glued onto it, which grips the underside of the front and rear working platforms when the wingnut 60 is tightened. In order to keep each clamping block assembly 53 in line with the adjustable end stop main body 50, a tubular spacer 62 (as shown in FIG. 21) is also located in each slot 52 and is fastened onto the clamping block assembly 53 by means of a round headed wood screw 64 and a large washer 63. The tubular spacer 62 is dimensioned so that it freely slides along the respective slot 52 to permit the clamping block assembly 53 to be moved inwardly or outwardly.

Figure 25:
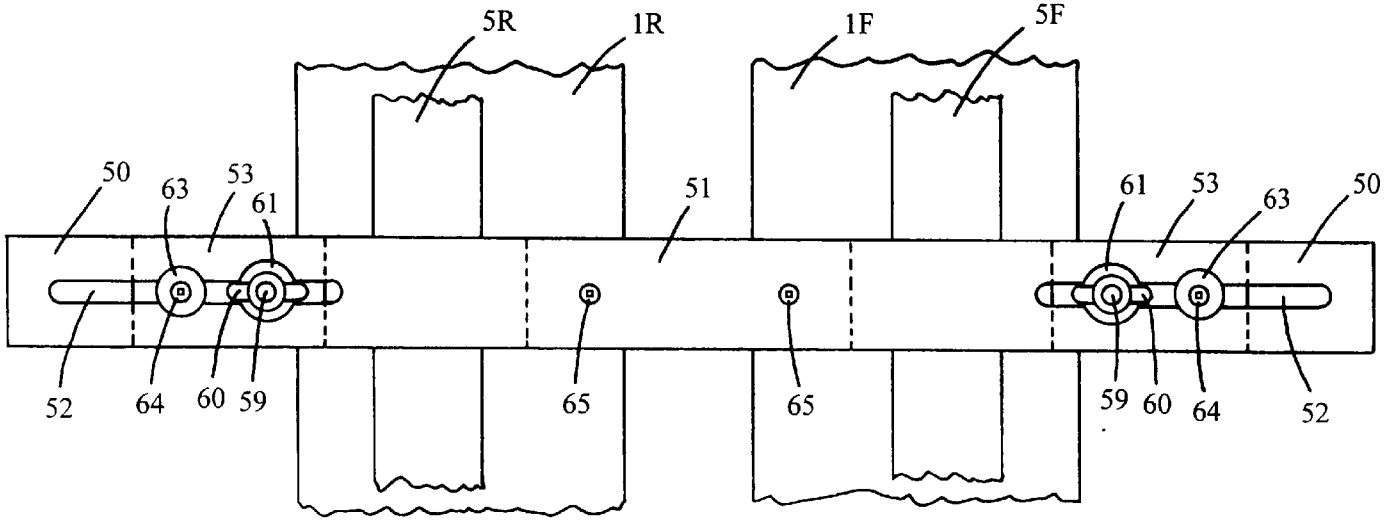
FIG. 25 shows a partial top view of the sideguide, showing how the adjustable end-stop is attached.

As shown in FIGS. 24 and 25, in use, each clamping block assembly 53 is positioned onto front and rear platform areas 1F, 1R. The end stop fence 51 attached underneath the main body 50 between front and rear guide fences 5F, 5R effectively stops the router baseplate at the intended stop positions. Note that the adjustable end stops should not be placed in position until after the front and rear guide fences have been correctly positioned.

Figure 26:
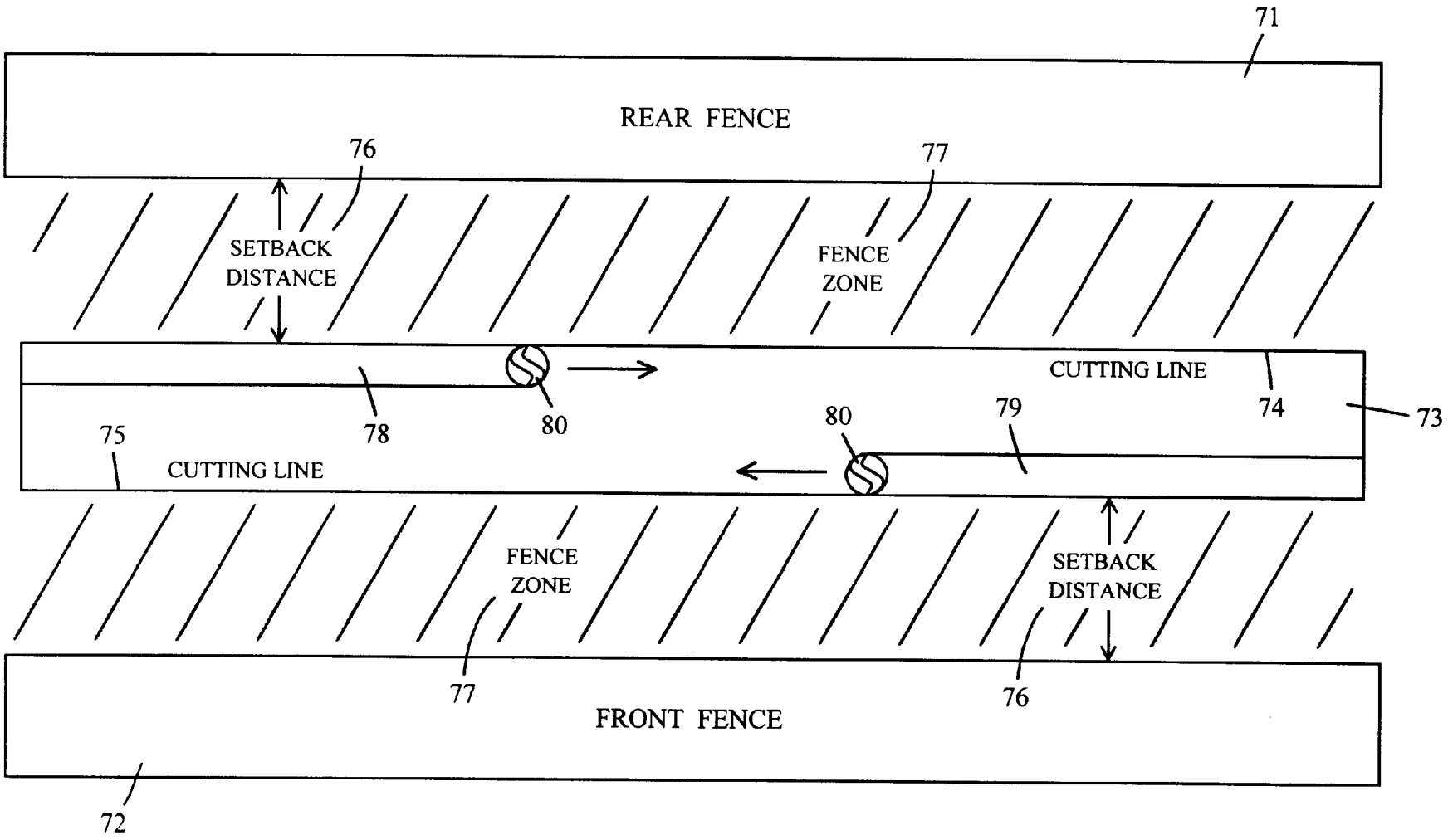
FIG. 26 illustrates the principle of operation for using the sideguide for an outside cut.
Figure 27:
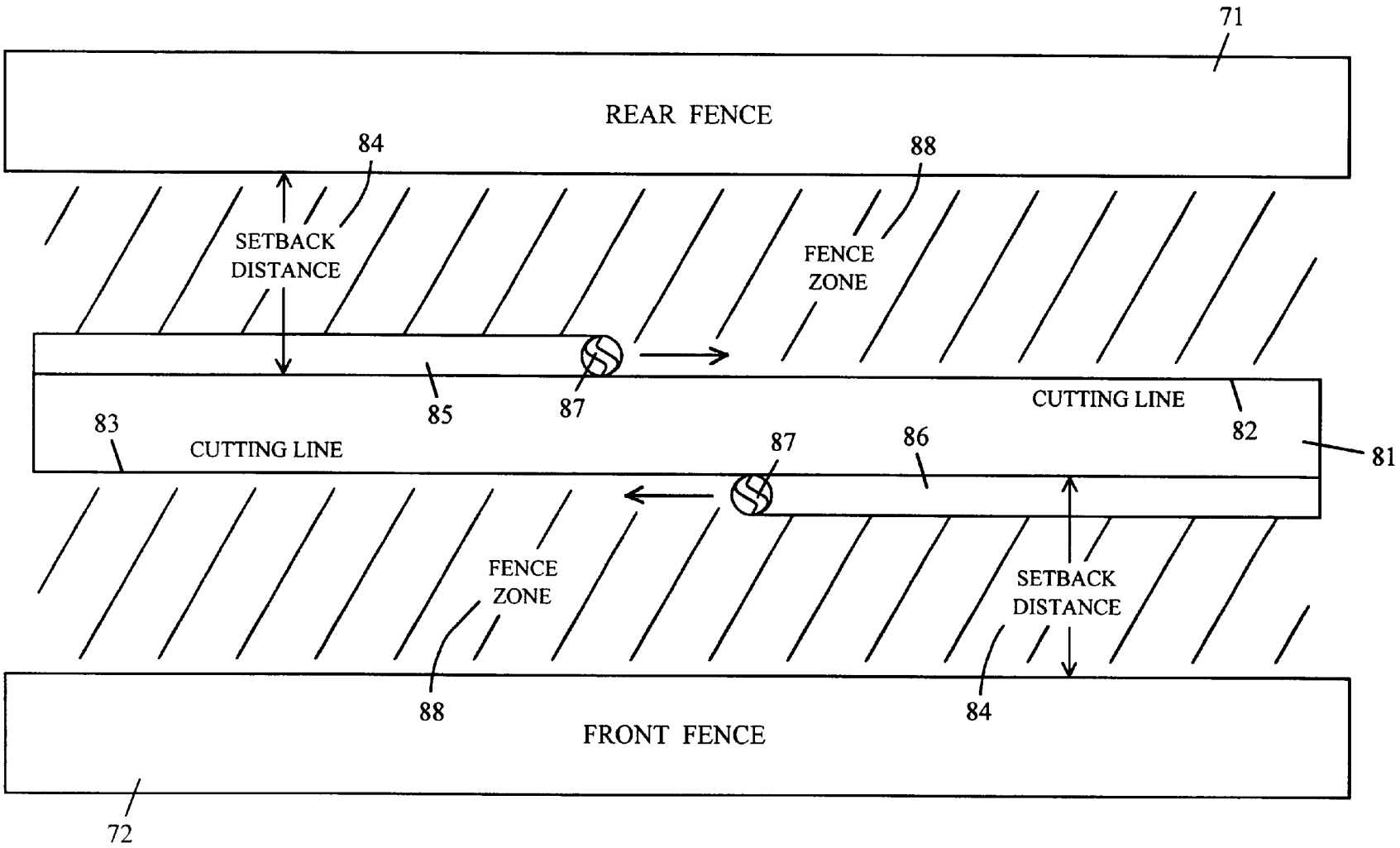
FIG. 27 illustrates the principle of operation for using the sideguide for an inside cut.

Now referring to FIGS. 26–27, the principle of operation for using the sideguide is shown. The rear and front fences 5R, 5F are represented by the rectangular-shaped fences 71 and 72, respectively. These are located along each side of a workpiece which has been clamped between the jaws 3R, 3F of the sideguide. FIG. 26 shows a wide groove 73 being routed into a workpiece between cutting lines 74 and 75. Both of the fences 71 and 72 will have to be positioned a specific distance away from their respective cutting lines 74 and 75. In each case this distance is called the setback distance 76. Also, the area that lies between each fence 71 and 72 and its respective cutting line 74 or 75 is called the fence zone 77. Each fence zone 77 is represented by a shaded area.

In order to cut the wide groove 73 into the workpiece, grooves 78 or 79 that are cut by the blade 80 would need to be on the side of the cutting lines 74 or 75 that is not inside either of the fence zones 77. Because the grooves 78 and 79 cut by the blade 80 are not inside either of the fence zones 77, they are called "outside cuts". Both of the fences 71 and 72 will be positioned accordingly, using the setback gauges described in the inventor's co-pending patent application Ser. No. 09/207,759 (Attorney Docket No. 10258-002).

The actual routing should be done from left to right while sliding the router along the rear fence 71 to cut the groove 78 along the rear cutting line 74, and then routing from right to left along the front fence 72 to cut the groove 79 along the front cutting line 75. If there is any unrouted material still remaining between those grooves 78 and 79, it can be routed in a random manner to complete the wide groove 73. Routing in this direction ensures that the natural action of the router presses the router against the appropriate fence 71 or 72.

Now referring to FIG. 27, this shows routing a tongue 81 onto a workpiece between the cutting lines 82 and 83. In this case, the fences 71 and 72 will have to be positioned a different setback distance 84 from their respective cutting lines 82 and 83. Because a tongue 81 is being cut, both of the grooves 85 and 86 cut by the blade 87 will need to be routed on the side of the cutting lines 82 and 83 that is inside the fence zone 88. In this case, the grooves 85 and 86 cut by the blade 87 will be inside the fence zone 88 so they are referred to as "inside cuts". Therefore, both of the fences 71 and 72 will have to be positioned accordingly, using the setback gauges described in the inventor's co-pending patent application Ser. No. 09/207,759. Again in this case, the actual routing should be done from left to right while sliding the router along the rear fence 71 to cut the groove 85 along the rear cutting line 82, for the rear side of the tongue 81, and then routing from right to left along the front fence 72 to cut the groove 86 along the front cutting line 83, for the front side of the tongue 81.

It is very important when making "inside cuts" that whenever the router is over the workpiece, the base of the router must always be held against the fence 71 or 72 for each side of the tongue 81 as it is being routed. This is because, if the router was allowed to move away from the fence in use, it would damage or destroy the tongue being cut. As there is a natural tendency for a router to move against the fence when making "inside cuts" due to the torque of the blade, the task of holding the router against the fence is made easier.

One advantage of using "inside cuts" for routing tongues is that the blade 87 uses an inward-cutting action to rout each side of the tongue 81, which virtually ensures that no breakouts will occur. Another advantage is that both sides of the tongue 81 can be cut in the same operation with only one setting for the fences 71 and 72. A precaution that must be taken when using "inside cuts" with the sideguide is that care must be taken to use a blade in the router that has a diameter that will be less than the width of the shoulder on each side of the tongue. This is to ensure that the blade does not cause damage to the platform areas of the sideguide during routing.

One operation that can be carried out using the sideguide is a "routerplaning" operation over a part of or all of the top surface area of a workpiece. Routerplaning is the process that uses only the tip of the router bit blade to rout the entire surface area of a workpiece, either to reduce its dimensions or to enable the surface area to be made level and true, which of necessity will also reduce its dimensions. Routerplaning can be performed at any angle and can be done on the sides, edges or ends of boards.

In order to avoid damaging the clamping jaws or the platform areas, the front and rear guide fences should be adjusted so that the router bit will not get closer than say ⅛" to either platform area. Afterwards, the narrow walls remaining on each side of the "routerplaned" area can be sanded off.

For best results, all routing should be done in steps of no more than ⅛" at a time. Also, all routerplaning should be done in steps of no more than 1/16" at a time, unless large amounts of material need to be removed.

While the above disclosure has set out in specific detail the preferred embodiment of the sideguide apparatus, it will be obvious to those skilled in the art that changes and modifications may be made without departing from the spirit and scope of the invention, as claimed in the following claims.

I claim:

1. An apparatus for use with a router and a workpiece, said router having a baseplate, an edge on said baseplate for guiding the router, and a router bit extending down below said baseplate for rotation about a router axis, said apparatus comprising:

(i) opposed front and rear jaw-pieces located on opposite sides of a gap for receiving the workpiece and being movable towards and away from one another;

(ii) clamping means connected to said jaw-pieces, said clamping means being actuatable, in use, to draw the front and rear jaw-pieces together, thereby to clamp said workpiece in the gap between the front and rear jaw-pieces, said clamping means being located above the front and rear jaw-pieces, so as not to obstruct the jaw-pieces and to permit a workpiece of indefinite length to be clamped between the front and rear jaw-pieces;

(iii) a platform area means for supporting said router over the workpiece, a platform area being provided on each of the front and rear jaw-pieces; and (iv) platform area holding means for maintaining said platform areas on said front and rear jaw-pieces coplanar.

2. An apparatus as claimed in claim 1, wherein the laterally adjustable guide means comprises a front guide fence adjustably mounted on the front platform area and a rear guide fence adjustably mounted on the rear platform area, the front and rear guide fences being adjustable towards and away from the gap.

3. An apparatus as claimed in claim 2, wherein the jaw-pieces include substantially planar clamping surfaces which are parallel to one another, and which face one another and wherein the front and rear platform areas are substantially perpendicular to the clamping surfaces and flush therewith.

4. An apparatus as claimed in claim 2, wherein the clamping means comprises first and second clamps provided at either end of the gap, and wherein each clamp comprises an elongate screw member rotatably mounted to one of the front and rear jaw-pieces, and an engagement member including a threaded bore, which the elongate screw member engages, the engagement member being mounted to the other of the front and rear jaw-pieces.

5. An apparatus as claimed in claim 4, wherein each screw clamp has a limited range of motion and is adjustably mounted to at least one of the front and rear jaw-pieces, to increase the respective range of motion thereof.

6. An apparatus as claimed in claim 5, wherein at least a part of said limited range of motion is provided by said threaded bore sliding freely relative to said engagement member.

7. An apparatus as claimed in claim 4, wherein, said platform area holding means comprises first and second end stops, provided at either end of the gap.

8. An apparatus as claimed in claim 7, wherein said first and second end stops each has a front end and a rear end, each of the front ends being fastened to said front platform area and each of said rear ends being adjustably fastened to said rear platform area, so as to allow said rear platform area to be moved towards, or away from, said front platform area.

9. An apparatus as claimed in claim 5, wherein each of the first and second clamps comprises a first housing in which the elongate screw is rotatably mounted and a second housing slidable mounted with respect to the first housing and in which the engagement member with a threaded bore is mounted, and wherein each of the first and second housings includes a mounting pin and each of the front and rear platform areas includes holes for receiving the mounting pins.

10. An apparatus as claimed in claim 9, wherein each of said front and rear platform areas has a plurality of holes spaced apart at regular intervals for receiving said mounting pins so as to provide a plurality of possible initial distance settings between said front and rear jaw-pieces.

11. An apparatus as claimed in claim 9, wherein for each of the first and second clamps, the first and second housings are telescopically mounted together, the elongate screw member includes a projecting end extending out from the first housing and an actuation handle is provided secured to the projecting end, for rotation of the corresponding elongate screw member.

12. An apparatus as claimed in claim 4 or 10, which includes an adjustable end stop having a main body defining an end guide surface, for sliding contact with the base plate of the router to guide the router, and securing means for removably securing the adjustable end stop to the front and rear platform areas.

13. An apparatus as claimed in claim 12, wherein the adjustable end stop has a main transverse member having a length sufficient to span across the gap and across the front and rear platform areas, an end guide fence extending downwardly from the transverse member, so as in use to be substantially flush with the front and rear platform areas and wherein the securing means comprises securing members for abutting the underside of the front and rear platform areas, and adjustable screw means for adjusting the spacing of the securing members along the transverse member.

14. An apparatus as claimed in claim 13, which includes two adjustable end stops.

15. An apparatus as claimed in claim 3, which includes scale markings along edges of the front and rear platform areas flush with the clamping faces.

16. An apparatus as claimed in claim 8, which includes scale markings to indicate the relative position of the front and rear guide fences and scale markings to indicate the relative position of the end stops.

17. An apparatus as claimed in claim 16, which includes supporting feet, mounted to the lowermost of the front and rear jaws and the front and rear platform areas, for supporting the apparatus on a horizontal surface.

* * * * *